US012157937B2

(12) United States Patent
Sasaki et al.

(10) Patent No.: US 12,157,937 B2
(45) Date of Patent: Dec. 3, 2024

(54) DUPLEX STAINLESS STEEL SEAMLESS PIPE AND METHOD FOR MANUFACTURING SAME

(71) Applicant: JFE Steel Corporation, Tokyo (JP)

(72) Inventors: Shunsuke Sasaki, Tokyo (JP); Tatsuro Katsumura, Tokyo (JP); Hiroki Ota, Tokyo (JP); Kazuki Fujimura, Tokyo (JP); Masao Yuga, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 639 days.

(21) Appl. No.: 17/296,626

(22) PCT Filed: Nov. 1, 2019

(86) PCT No.: PCT/JP2019/042969
§ 371 (c)(1),
(2) Date: May 25, 2021

(87) PCT Pub. No.: WO2020/110597
PCT Pub. Date: Jun. 4, 2020

(65) Prior Publication Data

US 2022/0018007 A1 Jan. 20, 2022

(30) Foreign Application Priority Data

Nov. 30, 2018 (JP) ..... 2018-224332

(51) Int. Cl.
*C22C 38/58* (2006.01)
*C22C 38/00* (2006.01)
(Continued)

(52) U.S. Cl.
CPC ..... *C22C 38/58* (2013.01); *C22C 38/001* (2013.01); *C22C 38/002* (2013.01);
(Continued)

(58) Field of Classification Search
CPC ..... B21D 3/14; C21D 2211/001; C21D 2211/005; C21D 6/004; C21D 6/005;
(Continued)

(56) References Cited

U.S. PATENT DOCUMENTS 10,184,160 B2 1/2019 Sawawatari et al.
2015/0107724 A1* 4/2015 Sawawatari ..... C22C 38/02 148/325
2021/0108297 A1* 4/2021 Tsuge ..... C21D 8/0205

FOREIGN PATENT DOCUMENTS

EP 2853614 A1 4/2015
EP 3569725 A1 11/2019
(Continued)

OTHER PUBLICATIONS

Extended European Search Report for European Application No. 19 890 675.2, dated Jan. 4, 2022, 8 pages.
(Continued)

*Primary Examiner* — Jenny R Wu
(74) *Attorney, Agent, or Firm* — Buchanan Ingersoll & Rooney PC

(57) ABSTRACT

Provided herein is a duplex stainless steel seamless pipe and a method for manufacturing the same. The duplex stainless steel seamless pipe has a composition comprising, in mass %, C: 0.005 to 0.08%, Si: 0.01 to 1.0%, Mn: 0.01 to 10.0%, Cr: 20 to 35%, Ni: 1 to 15%, Mo: 0.5 to 6.0%, N: 0.150 to less than 0.400%, and one, two or more selected from Ti: 0.0001 to 0.3%, Al: 0.0001 to 0.3%, V: 0.005 to 1.5%, Nb: 0.005 to less than 1.5%, and the balance being Fe and incidental impurities. The duplex stainless steel seamless pipe contains N, Ti, Al, V, and Nb so as to satisfy the following formula (1). The duplex stainless steel seamless pipe has an axial tensile yield strength of 757 MPa or more, and a ratio of 0.85 to 1.15 as a fraction of axial compressive yield strength to axial tensile yield strength.

$$0.150>N-(1.58Ti+2.70Al+1.58V+1.44Nb) \quad (1),$$

(Continued)

wherein N, Ti, Al, V, and Nb represent the content of each element in mass %.

18 Claims, 1 Drawing Sheet

(51) Int. Cl.

| | |
|---|---|
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01)

(58) Field of Classification Search
CPC .. C21D 7/13; C21D 8/105; C21D 9/08; C22C 38/001; C22C 38/002; C22C 38/005; C22C 38/02; C22C 38/04; C22C 38/06; C22C 38/42; C22C 38/44; C22C 38/46; C22C 38/48; C22C 38/50; C22C 38/54; C22C 38/58
See application file for complete search history.

(56) References Cited

FOREIGN PATENT DOCUMENTS

| | | | | |
|---|---|---|---|---|
| JP | 2009007638 | A | | 1/2009 |
| JP | 5500324 | B1 | | 5/2014 |
| JP | 2016117944 | A | * | 6/2016 |
| JP | 2016164288 | A | | 9/2016 |
| WO | 2017086169 | A1 | | 5/2017 |
| WO | 2018131412 | A1 | | 7/2018 |

OTHER PUBLICATIONS

International Search Report and Written Opinion for International Application No. PCT/JP2019/042969, dated Feb. 4, 2020, 5 pages.
Australian Examination Report for Australian Application No. 2019389490, dated Dec. 10, 2021, 2 pages.
Canadian Examination Report for Canadian Application No. 3,118,704, dated Feb. 25, 2022, 5 pages.
Office Action (Communication pursuant to Article 94(3) (EPC) issued Sep. 11, 2024, by the European Patent Office in corresponding European Patent Application No. 19 890 675.2-1103. (5 pages).

* cited by examiner

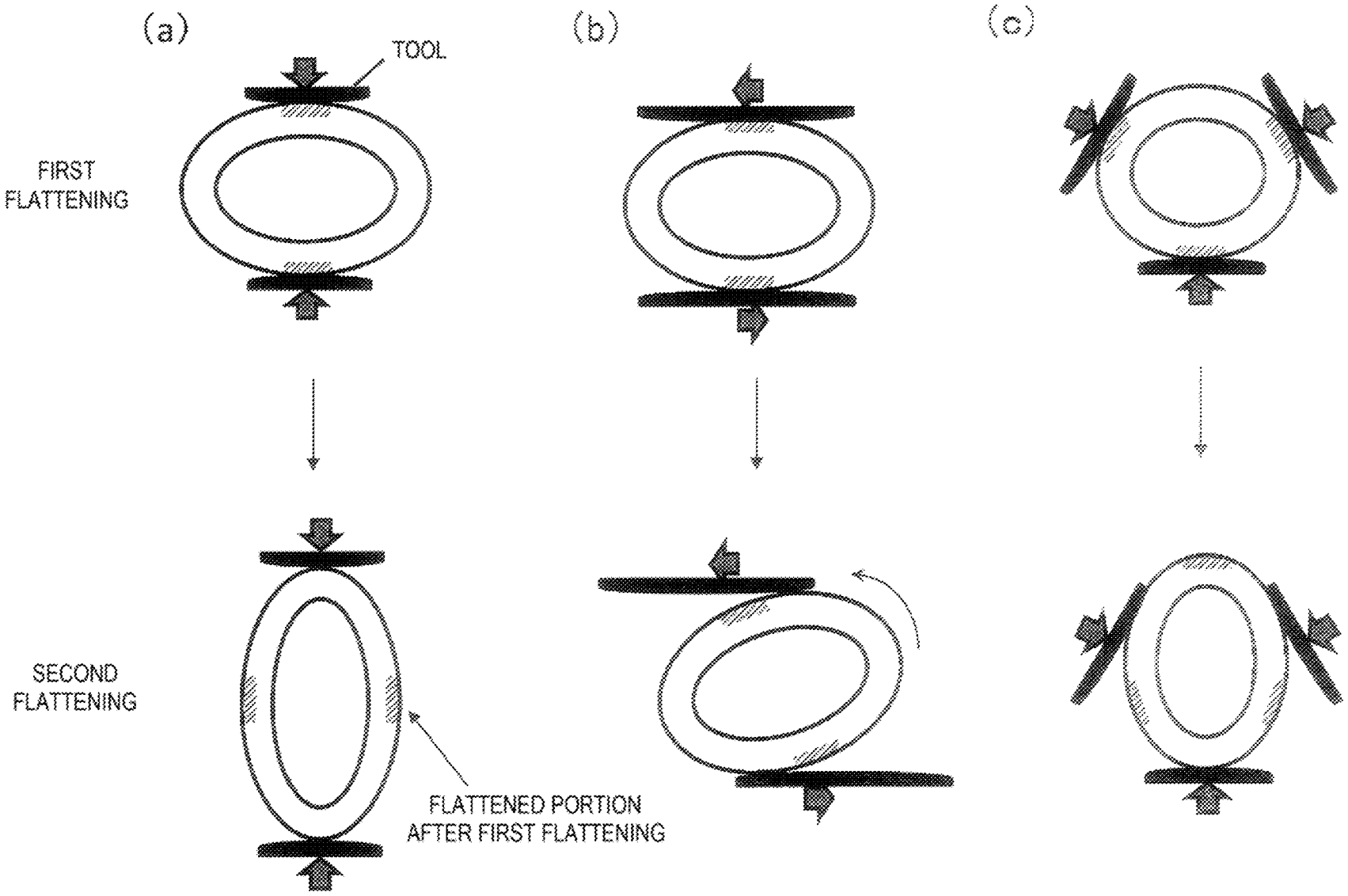
(a)
(b)
(c)
TOOL
FIRST FLATTENING
SECOND FLATTENING
FLATTENED PORTION AFTER FIRST FLATTENING

DUPLEX STAINLESS STEEL SEAMLESS PIPE AND METHOD FOR MANUFACTURING SAME

CROSS REFERENCE TO RELATED APPLICATIONS

This is the U.S. National Phase application of PCT/JP2019/042969 filed Nov. 1, 2019, which claims priority to Japanese Patent Application No. 2018-224332, filed Nov. 30, 2018, the disclosures of each of these applications being incorporated herein by reference in their entireties for all purposes.

FIELD OF THE INVENTION

The present invention relates to a duplex stainless steel seamless pipe having excellent axial tensile yield strength and excellent corrosion resistance and having a small difference between its axial tensile yield strength and compressive yield strength. The invention also relates to a method for manufacturing such a duplex stainless steel seamless pipe. Here, axial tensile yield strength and axial compressive yield strength having a small difference means that the ratio of axial compressive yield strength to axial tensile yield strength falls within a range of 0.85 to 1.15.

BACKGROUND OF THE INVENTION

Important considerations for seamless steel pipes used for mining of oil wells and gas wells include corrosion resistance that can withstand a highly corrosive environment under high temperature and high pressure, and high strength characteristics that can withstand the deadweight and the high pressure when the pipes are joined and used deep underground. Of importance for corrosion resistance is the amounts by which corrosion resistance improving elements such as Cr, Mo, W, and N are added to steel. In this regard, for example, various duplex stainless steels are available, including SUS329J3L containing 22% Cr, SUS329J4L containing 25% Cr, and ISO S32750 and S32760 containing Cr with increased amounts of Mo.

The most important strength characteristic is the axial tensile yield strength, and a value of axial tensile yield strength represents the specified strength of the product. This is most important because the pipe needs to withstand the tensile stress due to its own weight when joined and used deep underground. With a sufficiently high axial tensile yield strength against the tensile stress due to its weight, the pipe undergoes less plastic deformation, and this prevents damage to the passivation coating formed on pipe surface and is important for maintaining the corrosion resistance.

While the axial tensile yield strength is most important with regard to the specified strength of the product, the axial compressive yield strength is important for the pipe joint. From the standpoint of preventing fire or allowing for repeated insertion and removal, pipes used as oil country tubular goods such as in oil wells and gas wells cannot be joined by welding, and screws are used to fasten the joint. Compressive stress is produced in the screw thread along the axial direction of pipe in magnitudes that depend on the fastening force. This makes axial compressive yield strength important to withstand such compressive stress.

A duplex stainless steel has two phases in its microstructure: the ferrite phase, and the austenite phase which, crystallographically, has low yield strength. Because of this, a duplex stainless steel, in an as-processed form after hot forming or heat treatment, cannot provide the strength needed for use as oil country tubular goods. For this reason, pipes to be used as oil country tubular goods are processed to improve axial tensile yield strength by dislocation strengthening using various cold rolling techniques. Cold drawing and cold pilgering are two limited cold rolling techniques intended for pipes to be used as oil country tubular goods. In fact, NACE (The National Association of Corrosion Engineers), which provides international standards for use of oil country tubular goods, lists cold drawing and cold pilgering as the only definitions of cold rolling. These cold rolling techniques are both a longitudinal cold rolling process that reduces the wall thickness and diameter of pipe, and dislocation strengthening, which is induced by strain, acts most effectively for the improvement of tensile yield strength along the longitudinal axis of pipe. In the foregoing cold rolling techniques that longitudinally apply strain along the pipe axis, a strong Bauschinger effect occurs along a pipe axis direction, and the compressive yield strength along the axial direction of pipe is known to show an about 20% decrease. For this reason, it is common practice in designing strength to take the Bauschinger effect into account, and reduce the yield strength of the screw fastening portion where axial compressive yield strength characteristics are needed. However, this has become a limiting factor of the product specifications.

PTL 1 addresses this issue by proposing a duplex stainless steel pipe that contains, in mass %, C: 0.008 to 0.03%, Si: 0 to 1%, Mn: 0.1 to 2%, Cr: 20 to 35%, Ni: 3 to 10%, Mo: 0 to 4%, W: 0 to 6%, Cu: 0 to 3%, N: 0.15 to 0.35%, and the balance being iron and impurities, and has a tensile yield strength $YS_{LT}$ of 689.1 to 1000.5 MPa along an axial direction of the duplex stainless steel pipe, and in which the tensile yield strength, $YS_{LT}$, a compressive yield strength, $YS_{LC}$, along the axial direction of the pipe, a tensile yield strength, $YS_{CT}$, along a circumferential direction of the duplex stainless steel pipe, and a compressive yield strength, $YS_{CC}$, along the circumferential direction of the pipe satisfy predetermined formulae.

PATENT LITERATURE

PTL 1: Japanese Patent No. 5500324

SUMMARY OF THE INVENTION

However, PTL 1 does not give any consideration to corrosion resistance.

The present invention has been made under these circumstances, and it is an object of the present invention to provide a duplex stainless steel seamless pipe having excellent corrosion resistance and high axial tensile yield strength and having a small difference between its axial tensile yield strength and axial compressive yield strength. The invention is also intended to provide a method for manufacturing such a duplex stainless steel seamless pipe.

A duplex stainless steel contains increased solid-solution amounts of Cr and Mo in steel, and forms a highly corrosion-resistant coating, in addition to reducing localized progression of corrosion. In order to protect the material from various forms of corrosion, it is also of importance to bring the fractions of ferrite phase and austenite phase to an appropriate duplex state in the microstructure. The primary corrosion-resistant elements, Cr and Mo, are both ferrite phase-forming elements, and the phase fractions cannot be brought to an appropriate duplex state simply by increasing the contents of these elements. It is accordingly required to add appropriate amounts of austenite phase-forming elements. C, N, Mn, Ni, and Cu are examples of austenite phase-forming elements. Increasing the C content in steel impairs corrosion resistance, and the upper limit of carbon content should be limited. In a duplex stainless steel, the carbon content is typically 0.08% or less. Other austenite phase-forming elements are inexpensive to add, and nitrogen, which acts to improve corrosion resistance in the form of a solid solution and is effective for providing a solid solution strengthening effect, is often used.

A duplex stainless steel seamless pipe is used after a solid-solution heat treatment performed at a high temperature of at least 1,000° C. following hot forming, in order to form a solid solution of corrosion-resistant elements in steel, and to bring the phase fractions to an appropriate duplex state. This is followed by dislocation strengthening by cold rolling, should strengthening be needed. The product, in an as-processed form after the solid-solution heat treatment or cold rolling, shows high corrosion resistance performance with the presence of a solid solution of the elements that effectively provide corrosion resistance, and solid solution strengthening by solid solution nitrogen provides high strength. The strength improving effect by solid solution strengthening with nitrogen becomes more prominent with cold working.

A low-temperature heat treatment, such as that taught in PTL 1, is effective when decrease of compressive yield strength at the screw fastening portion due to the Bauschinger effect needs to be mitigated. In Examples of PTL 1, a heat treatment is carried out at 350° C. or 450° C. under all conditions to meet the required properties, and this heat treatment appears to be necessary. However, in a low-temperature heat treatment, the elements that dissolve into the steel in the solid-solution heat treatment diffuse, and the elements important for corrosion resistance performance are consumed as these elements precipitate in the form of carbonitrides, and lose their corrosion resistance effect. Here, a possible adverse effect of nitrogen is of concern when this element is intentionally added in large amounts to reduce cost and to improve corrosion resistance, or when nitrogen is contained in large amounts as a result of melting in the atmosphere or binding to other metallic elements added. Specifically, nitrogen, because of its small atomic size, easily diffuses even in a low-temperature heat treatment, and forms nitrides by binding to surrounding corrosion-resistant elements, with the result that the corrosion-resistant improving effect of these elements is lost. Many of the nitrides formed as a result of precipitation are nitrides of Cr and Mo, which are corrosion-resistant elements. The precipitates of these elements are large in size, and do not easily disperse and precipitate. Accordingly, the strength improving effect is much smaller than that produced by a solid solution of nitrogen formed in steel. That is, while it is desirable to reduce the N content to reduce a corrosion resistance performance drop, reducing the N content also reduces the effective amount of nitrogen for solid solution strengthening. This may result in decrease of strength after cold rolling following a solid-solution heat treatment, and the high strength needed for mining of oil wells may not be obtained with the chemical components used to form a duplex stainless steel, particularly when the percentage reduction of cross section ((cross sectional area of raw pipe before cold working—cross sectional area of raw pipe after cold working)/cross sectional area of raw pipe before cold working×100 [%]) is small. There accordingly is a need for a novel technique that improves strength without consuming Cr, Mo, and other corrosion-resistant elements in steel.

The present inventors conducted intensive studies of elements that could improve strength by precipitating and forming fine, dispersed nitrides while reducing a corrosion resistance performance drop by reducing Cr and Mo nitride formation, and found that addition of Ti, Al, V, and Nb, alone or in combination, is effective to this end. The following describes how these elements reduce a corrosion resistance performance drop. Table 1 represents the result of an investigation of temperatures at which Ti, Al, V, and Nb separately added to a duplex stainless steel (SUS329J4L, 25% Cr stainless steel) form nitrides upon cooling the stainless steel from its melting temperature.

TABLE 1

| Nitrides | Precipitation Temperature (° C.) |
|---|---|
| TiN | 1499 |
| AlN | 1486 |
| VN | 1282 |
| NbN | 1404 |

All of these elements formed nitrides at temperatures higher than the highest nitride-forming temperatures (1,000° C. or less) of corrosion-resistant elements Cr and Mo, making it possible to control consumption of the corrosion-resistant elements by fixing and controlling the amount of solid solution nitrogen before formation of Cr and Mo nitrides takes place. The following describes how high strength is achieved. Ti, Al, V, and Nb, which are added to control the amount of solid solution nitrogen, form nitrides. However, the nitrides of these elements are so refined in size that their precipitates are evenly distributed throughout the steel, and contribute to improving strength by precipitation strengthening (dispersion strengthening). That is, because Cr and Mo nitrides precipitate at relatively lower temperatures, the elements have shorter diffusion distances, and coarsely precipitate more at the grain boundary, where the diffusion rate is high. On the other hand, because Ti, Al, V, and Nb nitrides precipitate at higher temperatures, these elements are able to sufficiently diffuse, and form fine precipitates in a uniform fashion throughout the steel. That is, the present inventors found that addition of Ti, Al, V, and Nb enables the amount of solid solution nitrogen to be appropriately controlled, and promotes formation of fine precipitates in such a way as to enable control of consumption of corrosion-resistant elements Cr and Mo, and uniform formation of fine precipitates, which are effective for improving strength. That is, a technique is proposed with which the strength of a duplex stainless steel seamless pipe can be improved while maintaining its corrosion resistance performance.

After dedicated studies to find the optimum contents of Ti, Al, V, and Nb, the present inventors found that the foregoing effect can be stably obtained when the N content and the contents of Ti, Al, V, and Nb satisfy the following formula (1).

$$0.150>N-(1.58Ti+2.70Al+1.58V+1.44Nb) \quad (1)$$

In the formula, N, Ti, Al, V, and Nb represent the content of each element in mass %. (The content is 0 (zero) percent for elements that are not contained.)

The present invention has been made on the basis of these findings, and the gist of the embodiments of the present invention is as follows.

[1] A duplex stainless steel seamless pipe of a composition comprising, in mass %, C: 0.005 to 0.08%, Si: 0.01 to 1.0%, Mn: 0.01 to 10.0%, Cr: 20 to 35%, Ni: 1 to 15%, Mo: 0.5 to 6.0%, N: 0.150 to less than 0.400%, and one, two or more selected from Ti: 0.0001 to 0.3%, Al: 0.0001 to 0.3%, V: 0.005 to 1.5%, Nb: 0.005 to less than 1.5%, and the balance being Fe and incidental impurities, the duplex stainless steel seamless pipe containing N, Ti, Al, V, and Nb so as to satisfy the following formula (1), the duplex stainless steel seamless pipe having an axial tensile yield strength of 757 MPa or more, and a ratio of 0.85 to 1.15 as a fraction of axial compressive yield strength to axial tensile yield strength, $$0.150>N-(1.58Ti+2.70Al+1.58V+1.44Nb) \quad (1),$$

wherein N, Ti, Al, V, and Nb represent the content of each element in mass %. (The content is 0 (zero) percent for elements that are not contained.)

[2] The duplex stainless steel seamless pipe according to item [1], which has a ratio of 0.85 or more as a fraction of circumferential compressive yield strength to axial tensile yield strength.

[3] The duplex stainless steel seamless pipe according to item [1] or [2], which further comprises, in mass %, one or two selected from W: 0.1 to 6.0%, and Cu: 0.1 to 4.0%.

[4] The duplex stainless steel seamless pipe according to any one of items [1] to [3], which further comprises, in mass %, one, two or more selected from B: 0.0001 to 0.010%, Zr: 0.0001 to 0.010%, Ca: 0.0001 to 0.010%, Ta: 0.0001 to 0.3%, and REM: 0.0001 to 0.010%.

[5] A method for manufacturing the duplex stainless steel seamless pipe of any one of items [1] to [4], the method comprising stretching along a pipe axis direction followed by a heat treatment at a heating temperature of 150 to 600° C., excluding 460 to 480° C.

[6] A method for manufacturing the duplex stainless steel seamless pipe of any one of items [1] to [4], the method comprising stretching along a pipe axis direction at a temperature of 150 to 600° C., excluding 460 to 480° C.

[7] The method according to item [6], wherein the stretching is followed by a heat treatment at a heating temperature of 150 to 600° C., excluding 460 to 480° C.

[8] A method for manufacturing the duplex stainless steel seamless pipe of any one of items [1] to [4], the method comprising circumferential bending and rebending.

[9] The method according to item [8], wherein the circumferential bending and rebending is performed at a temperature of 600° C. or less, excluding 460 to 480° C.

[10] The method according to item [8] or [9], wherein the bending and rebending is followed by a heat treatment at a heating temperature of 150 to 600° C., excluding 460 to 480° C.

The present invention can provide a duplex stainless steel seamless pipe having high corrosion resistance performance and high strength, and having a small difference between its axial tensile yield strength and circumferential compressive yield strength. The duplex stainless steel seamless pipe of the present invention thus enables a screw fastening portion to be more freely designed while ensuring crushing strength, which is often evaluated in terms of axial tensile yield strength.

BRIEF DESCRIPTION OF DRAWINGS

FIG. 1 shows schematic views representing circumferential bending and rebending of pipe.

DETAILED DESCRIPTION OF EMBODIMENTS OF THE INVENTION

The present invention is described below.

The reasons for limiting the composition of a steel pipe of the present invention are described first. In the following, "%" means "mass %", unless otherwise specifically stated.

C: 0.005 to 0.08%

C is an austenite phase-forming element, and favorably serves to produce appropriate phase fractions when contained in appropriate amounts. However, when contained in excess amounts, C impairs the corrosion resistance by forming carbides. For this reason, the upper limit of C content is 0.08%. The lower limit is not necessarily needed because decrease of austenite phase due to reduced C contents can be compensated by other austenite phase-forming elements. However, the C content is 0.005% or more because excessively low C contents increase the cost of decarburization in melting the material.

Si: 0.01 to 1.0%

Si acts to deoxidize steel, and it is effective to add this element to the molten steel in appropriate amounts. However, any remaining silicon in steel due to excess silicon content impairs workability and low-temperature toughness. For this reason, the upper limit of Si content is 1.0%. The lower limit is 0.01% or more because excessively low Si contents after deoxidation increase manufacturing costs. From the viewpoint of reducing the undesirable effect of remaining excess silicon in steel while producing sufficient levels of deoxidation effect, the Si content is preferably 0.2 to 0.8%.

Mn: 0.01 to 10.0%

Mn is a strong austenite phase-forming element, and is available at lower costs than other austenite phase-forming elements. Unlike C and N, Mn does not consume the corrosion-resistant elements even in a low-temperature heat treatment. It is therefore required to add Mn in an amount of 0.01% or more, in order to bring the fraction of austenite phase to an appropriate duplex state in a duplex stainless steel seamless pipe of reduced C and N contents. On the other hand, when contained in excess amounts, Mn decreases low-temperature toughness. For this reason, the Mn content is 10.0% or less. The Mn content is preferably less than 1.0%, in order not to impair low-temperature toughness. When there is a need to adequately take advantage of Mn as an austenite phase-forming element to achieve cost reduction while taking care not to impair low-temperature toughness, the Mn content is preferably 2.0 to 8.0%. As for the lower limit, the Mn content is 0.01% or more because Mn is effective at canceling the harmful effect of impurity element of sulfur that mixes into the molten steel, and Mn has the effect to fix this element by forming MnS with sulfur, which greatly impairs the corrosion resistance and toughness of steel even when added in trace amounts.

Cr: 20 to 35%

Cr is the most important element in terms of increasing the strength of the passivation coating of steel, and improving corrosion resistance performance. The duplex stainless steel seamless pipe, which is used in severe corrosive environments, needs to contain at least 20% Cr. Cr contributes more to the improvement of corrosion resistance with increasing contents. However, with a Cr content of more than 35%, precipitation of embrittlement phase occurs in the process of solidification from the melt. This causes cracking throughout the steel, and makes the subsequent forming process difficult. For this reason, the upper limit is 35%. From the viewpoint of ensuring corrosion resistance and productivity, the Cr content is preferably 22 to 28%.

Ni: 1 to 15%

Ni is a strong austenite phase-forming element, and improves the low-temperature toughness of steel. It is therefore desirable to make active use of nickel when the use of manganese as an inexpensive austenite phase-forming element is an issue in terms of low-temperature toughness. To this end, the lower limit of Ni content is 1%. However, Ni is the most expensive element among the austenite phase-forming elements, and increasing the Ni content increases manufacturing costs. It is accordingly not desirable to add unnecessarily large amounts of nickel. For this reason, the upper limit of Ni content is 15%. When the low-temperature toughness is not of concern, it is preferable to use nickel in combination with other elements in an amount of 1 to 5%. On the other hand, when high low-temperature toughness is needed, it is effective to actively add nickel, preferably in an amount of 5 to 13%.

Mo: 0.5 to 6.0%

Mo increases the pitting corrosion resistance of steel in proportion to its content. This element is therefore added in amounts that depend on the corrosive environment. However, when Mo is added in excess amounts, precipitation of embrittlement phase occurs in the process of solidification from the melt. This causes large numbers of cracks in the solidification microstructure, and greatly impairs stability in the subsequent forming. For this reason, the upper limit of Mo content is 6.0%. While Mo improves the pitting corrosion resistance in proportion to its content, Mo needs to be contained in an amount of 0.5% or more to maintain stable corrosion resistance in a sulfide environment. From the viewpoint of satisfying both the corrosion resistance and production stability needed for the duplex stainless steel seamless pipe, the Mo content is preferably 1.0 to 5.0%.

N: 0.150 to Less Than 0.400%

N is a strong austenite phase-forming element, in addition to being inexpensive. In the form of a solid solution in steel, N is an element that is useful for improving corrosion resistance performance and strength, and is actively used. However, while N itself is inexpensive, excessive addition of nitrogen requires specialty equipment and time, and increases the manufacturing cost. For this reason, the upper limit of N content is less than 0.400%. The lower limit of N content should be 0.150% or more. In embodiments of the present invention, it is necessary to add any one of Ti, Al, V, and Nb, or two or more of these elements in combination. The cooling process after solidification forms fine nitrides of these elements, and produces a strength improving effect. Nitrogen needs to be contained in an amount of 0.150% or more for the lower limit because the strength improving effect tends to become unstable with excessively small N contents. The preferred N content for obtaining a sufficient strength improving effect is 0.155 to 0.320%.

One, two or more Selected from Ti: 0.0001 to 0.3%, Al: 0.0001 to 0.3%, V: 0.005 to 1.5%, and Nb: 0.005 to Less Than 1.5%

When contained in appropriate amounts, Ti, Al, V, and Nb form fine nitrides in the process of cooling from a dissolved state. This enables the solid-solution amount of nitrogen in steel to be appropriately controlled, in addition to improving strength. In this way, corrosion-resistant elements such as Cr and Mo become consumed in the form of nitrides, and coarsely precipitate, making it possible to reduce the simultaneous decrease of corrosion resistance performance and strength. The lower limits of these elements for obtaining the foregoing effect are Ti: 0.0001%, Al: 0.0001%, V: 0.005%, and Nb: 0.005% or more. Because excessive addition of these elements leads to cost increase and poor formability in hot working, Ti, Al, V, and Nb are contained in amounts of Ti: 0.3% or less, Al: 0.3% or less, V: 1.5% or less, and Nb: less than 1.5%.

The present invention can achieve both corrosion resistance performance and strength by satisfying the formula (1) below. Excessively large contents of Ti, Al, V, and Nb, alone or in combination, result in deficiency in the amount of nitrogen to be fixed, and the added elements remain in the steel, with the result that properties such as hot formability become unstable, even though the product characteristics are not necessarily affected. The upper limits of Ti, Al, V, and Nb are therefore more preferably Ti: 0.0500% or less, Al: 0.150% or less, V: 0.60% or less, and Nb: 0.60% or less. The corrosion resistance, strength, and hot formability can further stabilize when Ti, Al, V, and Nb, added either alone or in combination, fall in the preferred content ranges, and, at the same time, satisfy the formula (1) described below.

In embodiments of the present invention, N, Ti, Al, V, and Nb are contained so as to satisfy the following formula (1).

$$0.150>N-(1.58Ti+2.70Al+1.58V+1.44Nb) \quad (1)$$

In the formula, N, Ti, Al, V, and Nb represent the content of each element in mass %. (The content is 0 (zero) percent for elements that are not contained.)

Stable corrosion resistance performance and high strength can be achieved by satisfying the formula (1). That is, in embodiments of the present invention, the Ti, Al, V, and Nb contents should be optimized for the amount of nitrogen added to steel. When the contents of these elements are too low relative to the N content, it is not possible to sufficiently fix nitrogen and to achieve fine precipitation, with the result that the corrosion resistance performance and strength become unstable. Formula (1) is a formula that optimizes the contents of Ti, Al, V, Nb, which are added either alone or in combination, relative to the amount of nitrogen added. By satisfying formula (1), stable corrosion resistance performance and strength can be obtained.

The balance is Fe and incidental impurities. Examples of the incidental impurities include P: 0.05% or less, S: 0.05% or less, and 0: 0.01% or less. P, S, and O are incidental impurities that unavoidably mix into material at the time of smelting. When retained in excessively large amounts, these impurity elements cause a range of problems, including decrease of hot workability, and decrease of corrosion resistance and low-temperature toughness. The contents of these elements thus must be confined in the ranges of P: 0.05% or less, S: 0.05% or less, and 0: 0.01% or less.

In addition to the foregoing components, the following elements may be appropriately contained in the present invention, as needed.

One or two Selected from W: 0.1 to 6.0%, and Cu: 0.1 to 4.0% W: 0.1 to 6.0%

As is molybdenum, tungsten is an element that increases the pitting corrosion resistance in proportion to its content. However, when contained in excess amounts, tungsten impairs the workability of hot working, and damages production stability. For this reason, tungsten, when contained, is contained in an amount of at most 6.0%. Tungsten improves the pitting corrosion resistance in proportion to its content, and its content range does not particularly require the lower limit. It is, however, preferable to add tungsten in an amount of 0.1% or more, in order to stabilize the corrosion resistance performance of the duplex stainless steel seamless pipe. From the viewpoint of the corrosion resistance and production stability needed for the duplex stainless steel seamless pipe, the W content is more preferably 1.0 to 5.0%.

Cu: 0.1 to 4.0%

Cu is a strong austenite phase-forming element, and improves the corrosion resistance of steel. It is therefore desirable to make active use of Cu when sufficient corrosion resistance cannot be provided by other austenite phase-forming elements, Mn and Ni. On the other hand, when contained in excessively large amounts, Cu leads to decrease of hot workability, and forming becomes difficult. For this reason, Cu, when contained, is contained in an amount of 4.0% or less. The Cu content does not particularly require the lower limit. However, Cu can produce the corrosion resistance improving effect when contained in an amount of 0.1% or more. From the viewpoint of satisfying both corrosion resistance and hot workability, the Cu content is more preferably 1.0 to 3.0%.

The following elements may also be appropriately contained in the present invention, as needed.

One, two or more Selected from B: 0.0001 to 0.010%, Zr: 0.0001 to 0.010%, Ca: 0.0001 to 0.010%, Ta: 0.0001 to 0.3%, and REM: 0.0001 to 0.010%

When added in trace amounts, B, Zr, Ca, and REM improve bonding at grain boundaries. Trace amounts of these elements alter the form of surface oxides, and improve formability by improving the workability of hot working. As a rule, a duplex stainless steel seamless pipe is not an easily workable material, and often involves roll marks and shape defects that depend on the extent and type of working. B, Zr, Ca, and REM are effective against forming conditions involving such problems. The contents of these elements do not particularly require the lower limits. However, when contained, B, Zr, Ca, and REM can produce the workability and formability improving effect with contents of 0.0001% or more. When added in excessively large amounts, B, Zr, Ca, and REM impair the hot workability. Because B, Zr, Ca, and REM are rare elements, these elements also increase the alloy cost when added in excess amounts. For this reason, the upper limits of each B, Zr, Ca, and REM are 0.010%. When added in small amounts, Ta reduces transformation into the embrittlement phase, and, at the same time, improves the hot workability and corrosion resistance. For this reason, Ta, when contained, is contained in an amount of 0.0001% or more. These elements are effective when the embrittlement phase persists for extended time periods in a stable temperature region in hot working or in the subsequent cooling process. When Ta is added, the upper limit of Ta content is 0.3% because Ta increases the alloy cost when added in excessively large amounts.

The following describes the appropriate phase fractions of ferrite and austenite phase in the product, a property important for corrosion resistance.

The two different phases of the duplex stainless steel act differently on corrosion resistance, and produce high corrosion resistance by being present together in the steel. To this end, both the austenite phase and the ferrite phase must be present in the duplex stainless steel, and the phase fractions of these phases are also important for corrosion resistance performance. For example, The Japan Institute of Metals and Materials Newsletter, Technical Data, Vol. 17, No. 8 (1978) describes a relationship between the ferrite phase fraction of a 21 to 23% Cr duplex stainless steel and time to fracture of the material in a corrosive environment (FIG. 9, 662). It can be read from this relationship that the corrosion resistance is greatly impaired when the ferrite phase fraction is 20% or less, or 80% or more. Based on evidence that the fraction of ferrite phase has impact on corrosion resistance performance as supported by literature including the foregoing publication, ISO 15156-3 (NACE MR0175) specifies that a duplex stainless steel should have a ferrite phase fraction of 35% or more and 65% or less. The material used in the present invention is a duplex stainless steel pipe intended for applications requiring corrosion resistance performance, and it is important for corrosion resistance to create an appropriate duplex fraction state. As used herein, "appropriate duplex fraction state" means that the fraction of the ferrite phase in the microstructure of the duplex stainless steel pipe is at least 20% or more and 80% or less. When the product is to be used in an environment requiring even higher corrosion resistance, it is preferable that the ferrite phase be 35 to 65%, following ISO 15156-3.

The following describes a method for manufacturing a duplex stainless steel seamless pipe according to embodiments of the present invention.

First, a steel material of the foregoing duplex stainless steel composition is produced. The process for making the duplex stainless steel may use a variety of melting processes, and is not limited. For example, a vacuum melting furnace or an atmospheric melting furnace may be used when making the steel by electric melting of iron scrap or a mass of various elements. As another example, a bottom-blown decarburization furnace using an Ar—$O_2$ mixed gas, or a vacuum decarburization furnace may be used when using hot metal from a blast furnace. The molten material is solidified by static casting or continuous casting, and formed into ingots or slabs before being formed into a round billet by hot rolling or forging.

The round billet is heated by using a heating furnace, and formed into a steel pipe through various hot rolling processes. The round billet is formed into a hollow pipe by hot forming (piercing). Various hot forming techniques may be used, including, for example, the Mannesmann process, and the extrusion pipe-making process. It is also possible, as needed, to use, for example, an elongator, an assel mill, a mandrel mill, a plug mill, a sizer, or a stretch reducer as a hot rolling process that reduces the wall thickness of the hollow pipe, or sets the outer diameter of the hollow pipe.

Desirably, the hot forming is followed by a solid-solution heat treatment. In hot rolling, the duplex stainless steel undergoes a gradual temperature decrease while being hot rolled from the high-temperature state of heating. The duplex stainless steel is also typically air cooled after hot forming, and temperature control is not achievable because of the temperature history that varies with size and variety of products. This may lead to decrease of corrosion resistance as a result of the corrosion-resistant elements being consumed in the form of thermochemically stable precipitates that form in various temperature regions in the course of temperature decrease. There is also a possibility of phase transformation into the embrittlement phase, which leads to serious impairment of low-temperature toughness. The duplex stainless steel needs to withstand a variety of corrosive environments, and it is important to bring the fractions of austenite phase and ferrite phase to an appropriate duplex state for use. However, because the rate of cooling from the heating temperature is not controllable, controlling the fractions of these two phases, which vary in succession with the hold temperature, is difficult to achieve. To address these issues, a solid-solution heat treatment is often performed that involves rapid cooling after the high-temperature heating to form a solid solution of the precipitates in steel, and to initiate reverse transformation of embrittlement phase to non-embrittlement phase, and thereby bring the phase fractions to an appropriate duplex state. In this process, the precipitates and embrittlement phase are dissolved into steel, and the phase fractions are controlled to achieve an appropriate duplex state. The solid-solution heat treatment is typically performed at a high temperature of 1,000° C. or more, though the temperature that dissolves the precipitates, the temperature that initiates reverse transformation of embrittlement phase, and the temperature that brings the phase fractions to an appropriate duplex state slightly vary with the types of elements added. The heating is followed by quenching to maintain the solid-solution state. This may be achieved by compressed-air cooling, or by using various coolants, such as mist, oil, and water.

The seamless pipe after the solid-solution heat treatment contains the low-yield-strength austenite phase, and, in its as-processed form, cannot provide the strength needed for mining of oil wells and gas wells. This requires strengthening of the pipe by dislocation strengthening, using various techniques. The strength of the duplex stainless steel seamless pipe after strengthening is graded according to its axial tensile yield strength.

In embodiments of the present invention, the pipe is strengthened by using (1) a method that axially stretches the pipe, or (2) a method that involves circumferential bending and rebending of pipe, as follows.

(1) Axial Stretching of Pipe: Cold Drawing, Cold Pilgering

Cold drawing and cold pilgering are two standardized methods of cold rolling of pipes intended for mining of oil wells and gas wells. Both of these techniques can achieve high strength along a pipe axis direction, and can be used as appropriate. These techniques bring changes mostly in rolling reduction and the percentage of outer diameter change until the strength of the required grade is achieved. Another thing to note is that cold drawing and cold pilgering are a form of rolling that reduces the outer diameter and wall thickness of pipe to longitudinally stretch and greatly extend the pipe in the same proportion along the pipe axis. Indeed, longitudinal strengthening of pipe along the pipe axis is an easy process. A problem, however, is that these processes produce a large Bauschinger effect in a direction of compression along the pipe axis, and reduces the axial compressive yield strength by as large as about 20% relative to the axial tensile yield strength.

To avoid this, in embodiments of the present invention, a heat treatment is performed in a temperature range of 150 to 600° C., excluding 460 to 480° C., after the pipe is stretched along the pipe axis. By adding the essential elements Ti, Al, V, and Nb so as to satisfy formula (1), the nitrides finely precipitated in the steel under high temperature can maintain strength even after the heat treatment. With the controlled amount of solid solution nitrogen, it is also possible to inhibit precipitation of coarse nitrides of corrosion-resistant elements, Cr and Mo, making it possible to reduce decrease of corrosion resistance performance and strength. That is, the corrosion resistance performance can improve as compared to when the essential elements are not contained, and the decrease of axial compressive yield strength due to axial stretching can be reduced while ensuring high strength.

By stretching the pipe along the pipe axis in a temperature range of 150 to 600° C. excluding 460 to 480° C., a work load due to softening of the material during work can be reduced, in addition to the effect of the heat treatment described above. Decrease of axial compressive yield strength due to stretching along the pipe axis can be reduced without affecting the corrosion resistance, even when the post-stretching heat treatment and stretching are performed in combination at increased temperatures, provided that the essential elements are added. In the present invention, the heat treatment may follow stretching performed in a temperature range of 150 to 600° C., excluding 460 to 480° C., and the heating temperature of the heat treatment is preferably 150 to 600° C., excluding 460 to 480° C.

The upper limits of the stretching temperature and the heating temperature of the heat treatment need to be temperatures that do not dissipate the dislocation strengthening provided by the work, and the applied temperature should not exceed 600° C. Working temperatures of 460 to 480° C. should be avoided because this temperature range coincides with the embrittlement temperature of the ferrite phase, and possibly cause cracking during the process, in addition to causing deterioration of the product characteristics due to embrittlement of pipe.

A rapid yield strength drop occurs when the heating temperature of the heat treatment and the stretching temperature are below 150° C. In order to avoid this and to sufficiently produce the work load reducing effect, these processes are performed at a temperature of 150° C. or more. Preferably, the temperature is 350 to 450° C. to avoid passing the embrittlement phase during heating and cooling.

(2) Circumferential Bending and Rebending of Pipe

Dislocation strengthening involving circumferential bending and rebending of pipe can also be used for strengthening of pipe, though this is not a standardized technique of cold working of duplex stainless steel seamless pipes intended for mining of oil wells and gas wells. This working technique is described below, with reference to the accompanying drawing. Unlike cold drawing and cold pilgering that produce a longitudinal strain along a pipe axis direction, the foregoing technique produces strain by bending and flattening of pipe (first flattening), and rebending of pipe that restores full roundness (second flattening), as shown in FIG. 1. In this technique, the amount of strain is adjusted by repeating bending and rebending, or by varying the amount of bend. In either case, the strain imparted is an additive shear strain that does not involve a shape change before and after work. The technique also involves hardly any strain along a pipe axis direction, and high strength is achieved by dislocation strengthening due to the strain imparted in the circumference and wall thickness of the pipe. This makes it possible to reduce the Bauschinger effect along a pipe axis direction. That is, unlike cold drawing and cold pilgering, the technique does not involve decrease of axial compressive strength, or causes only a small decrease of compressive strength, if any. This makes it possible to more freely design the screw fastening portion. The circumferential compressive strength also improves when the pipe is worked to reduce its outer circumference. In this way, a strong steel pipe can be produced that can withstand the external pressure encountered in mining of deep oil wells and gas wells. Circumferential bending and rebending cannot produce a large change in outer diameter and wall thickness to the same extent as cold drawing and cold pilgering, but is particularly effective when there is a need to reduce the strength anisotropy along a pipe axis direction and along a circumferential compressional direction against the axial stretch.

FIG. 1, (a) and (b) show cross sectional views illustrating a tool with two points of contact. FIG. 1, (c) is a cross sectional view showing a tool with three points of contact. Thick arrows in FIG. 1 indicate the direction of exerted force flattening the steel pipe. As shown in FIG. 1, for second flattening, the tool may be moved or shifted in such a manner as to rotate the steel pipe and make contact with portions of pipe that were not flattened by the first flattening (portions flattened by the first flattening are indicated by shadow shown in FIG. 1).

As illustrated in FIG. 1, the circumferential bending and rebending that flattens the steel pipe, when intermittently or continuously applied throughout the pipe circumference, produces strain in the pipe, with bending strain occurring in portions where the curvature becomes the largest, and rebending strain occurring toward portions where the curvature is the smallest. The strain needed to improve the strength of the steel pipe (dislocation strengthening) accumulates after the deformation due to bending and rebending. Unlike the working that achieves reduced wall thickness and reduced outer diameter by compression, a characteristic feature of the foregoing method is that the pipe is deformed by being flattened, and, because this is achieved without requiring large power, it is possible to minimize the shape change before and after work.

A tool used to flatten the steel pipe, such as that shown in FIG. 1, may have a form of a roll. In this case, two or more rolls may be disposed around the circumference of a steel pipe. Deformation and strain due to repeated bending and rebending can be produced with ease by flattening the pipe and rotating the pipe between the rolls. The rotational axis of the roll may be tilted within 90° of the rotational axis of the pipe. In this way, the steel pipe moves in a direction of its rotational axis while being flattened, and can be continuously worked with ease. When using such rolls for continuous working, for example, the distance between the rolls may be appropriately varied in such a manner as to change the extent of flattening of a moving steel pipe. This makes it easy to vary the curvature (extent of flattening) of the steel pipe in the first and second runs of flattening. That is, by varying the roll distance, the moving path of the neutral line can be changed to uniformly produce strain in a wall thickness direction. The same effect can be obtained when the extent of flattening is varied by varying the roll diameter, instead of roll distance. It is also possible to vary both roll distance and roll diameter. With three or more rolls, the pipe can be prevented from whirling around during work, and this makes the procedure more stable, though the system becomes more complex.

The circumferential bending and rebending of pipe may be performed at ordinary temperature. With the circumferential bending and rebending performed at ordinary temperature, all the nitrogen can turn into a solid solution, and this is preferable from the viewpoint of corrosion resistance. However, adding the essential elements is effective because these elements enable the work temperature to be increased to soften the material, when working is not easily achievable with a high load put on cold working. The upper limit of the work temperature needs to be a temperature that does not dissipate the dislocation strengthening provided by the work, and the applied temperature should not exceed 600° C. Work temperatures of 460 to 480° C. should be avoided because this temperature range coincides with the embrittlement temperature of the ferrite phase, and possibly cause cracking during the process, in addition to causing deterioration of the product characteristics due to embrittlement of pipe. The preferred work temperature of circumferential bending and rebending of pipe is therefore 600° C. or less, excluding 460 to 480° C. More preferably, the upper limit of work temperature is 450° C. from a standpoint of saving energy and avoiding passing the embrittlement phase during heating and cooling. With an increased work temperature, the strength anisotropy of the pipe after work can be reduced to some extent, and increasing the work temperature is also effective when the strength anisotropy is of concern.

In the present invention, the foregoing method (1) or (2) used for dislocation strengthening may be followed by a further heat treatment. By adding the essential elements so as to satisfy formula (1), the strength can improve through formation of fine precipitates with the elements added, and the amount of solid solution nitrogen can be controlled to prevent decrease of corrosion resistance and strength due to heat treatment. The strength anisotropy can also improve while maintaining these properties. The heating temperature of the heat treatment is preferably 150° C. or more because a heating temperature of less than 150° C. coincides with a temperature region where a rapid decrease of yield strength occurs. The upper limit of the heating temperature needs to be a temperature that does not dissipate the dislocation strengthening provided by the work, and the applied temperature should not exceed 600° C. Heating temperatures of 460 to 480° C. should be avoided because this temperature range coincides with the embrittlement temperature of the ferrite phase, and causes deterioration of the product characteristics due to embrittlement of pipe. It is accordingly preferable that the heat treatment, when performed, be performed at 150 to 600° C., excluding 460 to 480° C. More preferably, the heating temperature is 350 to 450° C. from a standpoint of saving energy and avoiding passing the embrittlement phase during heating and cooling, in addition to producing the anisotropy improving effect. The rate of cooling after heating may be a rate achievable by air cooling or water cooling.

A duplex stainless steel seamless pipe of the present invention can be produced by using the manufacturing method described above. Grading of the strength of duplex stainless steel seamless pipes intended for oil wells and gas wells is based on tensile yield strength along the pipe axis, which experiences the highest load. A duplex stainless steel seamless pipe according to embodiments of the present invention has a tensile yield strength of at least 757 MPa along a pipe axis direction. Typically, a duplex stainless steel contains the soft austenite phase in its microstructure, and a tensile yield strength of 757 MPa cannot be achieved along a pipe axis direction in an as-processed form after the solid-solution heat treatment. The axial tensile yield strength of the heat-treated duplex stainless steel is thus adjusted by dislocation strengthening achieved by the cold working described above (axial stretching or circumferential bending and rebending of pipe). In terms of cost, it is advantageous to have higher axial tensile yield strengths because it allows for pipe design with a thinner wall for mining of wells. However, when only the wall thickness is reduced without varying the outer diameter of pipe, the pipe becomes susceptible to crushing under the external pressure exerted deep underground, and this makes the pipe useless. For this reason, many pipes have an axial tensile yield strength of at most 1033.5 MPa.

In embodiments of the present invention, the ratio of axial compressive yield strength to axial tensile yield strength of pipe is 0.85 to 1.15 (axial compressive yield strength/axial tensile yield strength). With the ratio falling in this range, the steel pipe can withstand higher axial compressive stress when fastening a screw or when the steel pipe is bent in a well. This enables the steel pipe to have the reduced wall thickness needed to withstand compressive stress. The improved flexibility of design of pipe wall thickness, particularly, the wider range of reducible wall thickness lowers the material cost, which lowers the manufacturing cost and improves the yield. With warm stretching or bending and rebending, the ratio of axial compressive yield strength to axial tensile yield strength of pipe can be brought to 0.85 to 1.15, and the pipe strength improves while maintaining the corrosion resistance, provided that the essential elements are added. With warm bending and rebending, or with a low-temperature heat treatment performed after the foregoing processes, the ratio of axial compressive yield strength to axial tensile yield strength of pipe can be brought closer to 1, toward a smaller anisotropy.

In embodiments of the present invention, the ratio of circumferential compressive yield strength to axial tensile yield strength of pipe is preferably 0.85 or more (circumferential compressive yield strength/axial tensile yield strength). Given the same wall thickness, the reachable depth of well mining depends on the axial tensile yield strength of pipe. In order to prevent crushing under the external pressure exerted deep underground, the pipe should have strength with a ratio of circumferential compressive yield strength to axial tensile yield strength of 0.85 or more. Having a higher circumferential compressive yield strength than axial tensile yield strength is not particularly a problem; however, the effect typically becomes saturated when the ratio is about 1.50. When the strength ratio is too high, other mechanical characteristics (e.g., low-temperature toughness) along a pipe circumferential direction greatly decrease compared to that in a pipe axis direction. The ratio is therefore more preferably 0.85 to 1.25.

In embodiments of the present invention, the aspect ratio of austenite grains separated by a crystal orientation angle difference of 15° or more in a cross section across the wall thickness along the pipe axis is preferably 9 or less. It is also preferable that austenite grains with an aspect ratio of 9 or less have an area fraction of 50% or more. A duplex stainless steel according to embodiments of the present invention is adjusted to have an appropriate ferrite phase fraction by heating in a solid-solution heat treatment. Here, inside of the remaining austenite phase is a microstructure having a plurality of crystal grains separated by an orientation angle of 15° or more after the recrystallization occurring during the hot working and heat treatment. This makes the aspect ratio of austenite grains smaller. In this state, the duplex stainless steel seamless pipe does not have the axial tensile yield strength needed for use as oil country tubular goods, and the ratio of axial compressive yield strength to axial tensile yield strength is close to 1. In order to produce the axial tensile yield strength needed for oil country tubular goods applications, the steel pipe is subjected to (1) axial stretching (cold drawing, cold pilgering), and (2) circumferential bending and rebending. In these processes, changes occur in the ratio of axial compressive yield strength to axial tensile yield strength, and in the aspect ratio of austenite grains. That is, the aspect ratio of austenite grains, and the ratio of axial compressive yield strength to axial tensile yield strength are closely related to each other. Specifically, while (1) or (2) improves the yield strength in a direction of stretch of austenite grains before and after work in a cross section across the wall thickness along the pipe axis, the yield strength decreases in the opposite direction because of the Bauschinger effect, with the result that the axial compressive yield strength-to-axial tensile yield strength ratio decreases. This means that a steel pipe of small strength anisotropy along the pipe axis can be obtained when austenite grains before and after the process (1) or (2) have a small, controlled, aspect ratio.

In the present invention, a stable steel pipe with a small strength anisotropy can be obtained when the austenite phase has an aspect ratio of 9 or less. A stable steel pipe with a small strength anisotropy can also be obtained when austenite grains having an aspect ratio of 9 or less have an area fraction of 50% or more. An even more stable steel pipe with a small strength anisotropy can be obtained when the aspect ratio is 5 or less. Smaller aspect ratios mean smaller strength anisotropies, and, accordingly, the aspect ratio should be brought closer to 1, with no lower limit. The aspect ratio of austenite grains is determined, for example, as a ratio of the longer side and shorter side of a rectangular frame containing grains having a crystal orientation angle of 15° or more observed in the austenite phase in a crystal orientation analysis of a cross section across the wall thickness along the pipe axis. Here, austenite grains of small particle diameters are prone to producing large measurement errors, and the presence of such austenite grains of small particle diameters may cause errors in the aspect ratio. It is accordingly preferable that the austenite grain used for aspect ratio measurement be at least 10 μm in terms of a diameter of a true circle of the same area constructed from the measured grain.

In order to stably obtain a microstructure of austenite grains having a small aspect ratio in a cross section across the wall thickness along the pipe axis, it is effective not to stretch the pipe along the pipe axis, and not to reduce the wall thickness in the process (1) or (2). The process (1), in principle, involves stretching along the pipe axis, and reduction of wall thickness. Accordingly, the aspect ratio is larger after work than before work, and this tends to produce strength anisotropy. It is therefore required to maintain a small aspect ratio by reducing the extent of work (the wall thickness reduction is kept at 40% or less, or the axial stretch is kept at 50% or less to reduce stretch in microstructure), and by decreasing the outer circumference of the pipe being stretched to reduce the wall thickness (the outer circumference is reduced at least 10% while stretching the pipe along the pipe axis). It is also required to perform a low-temperature heat treatment after work (softening due to recrystallization or recovery does not occur with a heat-treatment temperature of 560° C. or less) so as to reduce the generated strength anisotropy. The process (2) produces circumferential deformation by bending and rebending, and, accordingly, the aspect ratio basically remains unchanged. This makes the process (2) highly effective at maintaining a small aspect ratio and reducing strength anisotropy, though the process is limited in terms of the amount of shape change that can be attained by stretching or wall thickness reduction of pipe. This process also does not require the post-work low-temperature heat treatment needed in (1). Austenite grains having an aspect ratio of 9 or less can have an area fraction in a controlled range of 50% or more by controlling the work temperature and the heating conditions of (1)

within the ranges of the present invention, or by using the process (2).

A heat treatment performed after the process (1) or (2) does not change the aspect ratio. Preferably, the ferrite phase should have a smaller aspect ratio for the same reasons described for the austenite phase. However, the austenite phase has a smaller yield strength, and its impact on the Bauschinger effect after work is greater than ferrite phase.

Examples

The present invention is further described below through Examples.

The chemical components represented by A to AK in Table 2 were made into steel with a vacuum melting furnace, and the steel was hot rolled into a round billet having a diameter ϕ of 60 mm.

TABLE 2

(mass %)

| Steel type | C | Si | Mn | Cr | Ni | Mo | W | Cu | N | Ti | Al | V | Nb | B, Zr, Ca, Ta, REM |
|---|---|---|---|---|---|---|---|---|---|---|---|---|---|---|
| A | 0.028 | 0.5 | 0.3 | 22.2 | 5.1 | 2.8 | 0.0 | 0.0 | 0.145 | — | — | — | — | |
| B | 0.028 | 0.5 | 0.3 | 22.1 | 5.0 | 2.8 | 0.0 | 0.0 | 0.155 | 0.008 | — | — | — | |
| C | 0.025 | 0.4 | 0.3 | 22.2 | 5.1 | 3.2 | 0.0 | 0.0 | 0.196 | — | 0.030 | — | — | |
| D | 0.025 | 0.4 | 0.3 | 22.2 | 5.1 | 3.3 | 0.0 | 0.0 | 0.185 | — | — | 0.030 | — | |
| E | 0.022 | 0.1 | 0.2 | 22.3 | 5.3 | 3.3 | 0.0 | 0.0 | 0.192 | — | — | — | 0.040 | |
| F | 0.021 | 0.1 | 0.2 | 22.2 | 5.1 | 3.2 | 0.0 | 0.0 | 0.188 | 0.003 | 0.020 | — | — | |
| G | 0.016 | 0.1 | 0.2 | 22.2 | 4.8 | 3.2 | 0.0 | 0.0 | 0.198 | 0.003 | — | 0.040 | — | |
| H | 0.018 | 0.1 | 0.2 | 22.3 | 4.9 | 3.2 | 0.0 | 0.0 | 0.194 | 0.002 | — | — | 0.050 | |
| I | 0.017 | 0.1 | 0.2 | 22.1 | 4.8 | 3.2 | 0.0 | 0.0 | 0.185 | — | 0.020 | 0.030 | — | |
| J | 0.018 | 0.1 | 0.2 | 22.3 | 4.9 | 3.2 | 0.0 | 0.0 | 0.188 | — | 0.030 | — | 0.040 | |
| K | 0.017 | 0.1 | 0.2 | 22.2 | 5.0 | 3.2 | 0.0 | 0.0 | 0.221 | — | — | 0.040 | 0.050 | |
| L | 0.018 | 0.1 | 0.3 | 22.1 | 4.9 | 3.2 | 0.0 | 0.0 | 0.286 | — | 0.080 | — | — | |
| M | 0.018 | 0.1 | 0.2 | 22.2 | 5.1 | 3.2 | 0.0 | 0.0 | 0.315 | — | — | 0.110 | — | |
| N | 0.017 | 0.1 | 0.2 | 22.3 | 5.2 | 3.3 | 0.0 | 0.0 | 0.295 | — | — | — | 0.130 | |
| O | 0.015 | 0.1 | 0.2 | 22.2 | 5.1 | 3.2 | 0.0 | 0.0 | 0.315 | 0.004 | 0.030 | 0.040 | 0.040 | |
| P | 0.018 | 0.1 | 0.3 | 22.3 | 5.0 | 3.1 | 1.1 | 0.0 | 0.212 | 0.003 | 0.040 | — | — | |
| Q | 0.017 | 0.1 | 0.2 | 22.3 | 5.0 | 3.2 | 0.0 | 2.1 | 0.195 | 0.003 | 0.030 | — | — | |
| R | 0.021 | 0.1 | 0.2 | 22.4 | 5.1 | 3.2 | 1.8 | 1.5 | 0.243 | 0.003 | 0.020 | 0.040 | — | Ca: 0.0008 |
| S | 0.021 | 0.1 | 0.2 | 22.3 | 5.0 | 3.1 | 1.1 | 0.8 | 0.211 | 0.003 | 0.030 | 0.020 | — | Ca: 0.0008, B: 0.003 |
| T | 0.018 | 0.1 | 0.2 | 25.3 | 7.1 | 3.2 | 0.4 | 0.3 | 0.225 | 0.003 | 0.040 | — | — | |
| U | 0.019 | 0.1 | 0.2 | 25.4 | 7.0 | 3.3 | 0.4 | 0.4 | 0.255 | 0.003 | 0.030 | 0.030 | — | Ca: 0.0008 |
| V | 0.019 | 0.1 | 0.2 | 25.4 | 6.9 | 3.2 | 0.4 | 0.3 | 0.285 | 0.003 | 0.020 | 0.030 | 0.040 | B: 0.003 |
| W | 0.02 | 0.1 | 0.2 | 25.4 | 7.0 | 3.1 | 0.4 | 0.3 | 0.288 | 0.003 | 0.020 | — | 0.080 | Ca: 0.0009, B: 0.004, Ta: 0.15 |
| X | 0.021 | 0.1 | 0.2 | 25.3 | 6.9 | 3.3 | 0.4 | 0.4 | 0.291 | 0.003 | 0.020 | 0.080 | — | Ca: 0.0009, B: 0.004, REM: 0.0004 |
| Y | 0.015 | 0.1 | 0.3 | 25.4 | 7.1 | 3.4 | 0.4 | 0.3 | 0.284 | 0.002 | 0.010 | 0.040 | 0.040 | Ca: 0.0009, B: 0.004, Zr: 0.003, REM: 0.0005 |
| Z | 0.018 | 0.1 | 0.3 | 25.3 | 7.0 | 3.3 | 0.4 | 0.3 | 0.283 | 0.002 | 0.020 | 0.030 | 0.040 | |
| AA | 0.016 | 0.1 | 0.2 | 25.6 | 7.2 | 3.5 | 0.0 | 0.0 | 0.265 | 0.003 | 0.040 | 0.030 | 0.010 | |
| AB | 0.019 | 0.1 | 0.2 | 25.4 | 7.1 | 3.3 | 1.5 | 0.5 | 0.285 | 0.003 | 0.030 | 0.060 | — | |
| AC | 0.017 | 0.1 | 0.2 | 25.4 | 6.8 | 3.7 | 0.3 | 1.5 | 0.311 | 0.003 | 0.030 | 0.080 | — | |
| AD | 0.016 | 0.1 | 8.8 | 25.3 | 1.6 | 2.7 | 0.0 | 0.0 | 0.198 | 0.003 | 0.030 | — | — | Ca: 0.007, B: 0.008 |
| AE | 0.017 | 0.1 | 0.2 | 22.3 | 5.0 | 2.8 | 0.0 | 0.0 | 0.167 | — | — | — | — | |
| AF | 0.018 | 0.1 | 0.2 | 25.4 | 7.0 | 3.3 | 0.4 | 0.3 | 0.208 | 0.003 | 0.020 | — | — | |
| AG | 0.022 | 0.3 | 0.3 | 22.3 | 7.0 | 3.2 | 1.1 | 0.0 | 0.193 | 0.001 | 0.010 | 0.010 | — | |
| AH | 0.030 | 0.5 | 0.3 | 19.3 | 3.1 | 1.8 | 0.0 | 0.0 | 0.156 | 0.003 | 0.008 | — | — | |
| AI | 0.030 | 0.3 | 0.3 | 26.8 | 0.4 | 2.1 | 0.0 | 0.0 | 0.165 | 0.003 | — | 0.010 | — | |
| AJ | 0.095 | 0.5 | 0.3 | 22.4 | 4.0 | 2.0 | 0.0 | 0.5 | 0.155 | — | — | 0.010 | 0.010 | |
| AK | 0.030 | 0.4 | 0.4 | 25.5 | 3.8 | 0.4 | 0.0 | 0.6 | 0.188 | 0.002 | 0.008 | 0.020 | 0.010 | |

(mass %)

| Steel type | Formula (1) satisfied or unsatisfied | Right-hand side of formula (1) | Microstructure | Remarks |
|---|---|---|---|---|
| A | Satisfied | 0.145 | Ferrite-austenite phase | Comparative Example |
| B | Satisfied | 0.142 | Ferrite-austenite phase | Present Example |
| C | Satisfied | 0.139 | Ferrite-austenite phase | Present Example |
| D | Satisfied | 0.138 | Ferrite-austenite phase | Present Example |
| E | Satisfied | 0.134 | Ferrite-austenite phase | Present Example |
| F | Satisfied | 0.145 | Ferrite-austenite phase | Present Example |
| G | Satisfied | 0.130 | Ferrite-austenite phase | Present Example |
| H | Satisfied | 0.119 | Ferrite-austenite phase | Present Example |
| I | Satisfied | 0.100 | Ferrite-austenite phase | Present Example |
| J | Satisfied | 0.073 | Ferrite-austenite phase | Present Example |
| K | Satisfied | 0.086 | Ferrite-austenite phase | Present Example |
| L | Satisfied | 0.134 | Ferrite-austenite phase | Present Example |

TABLE 2-continued

| | | | | |
|---|---|---|---|---|
| M | Satisfied | 0.141 | Ferrite-austenite phase | Present Example |
| N | Satisfied | 0.108 | Ferrite-austenite phase | Present Example |
| O | Satisfied | 0.131 | Ferrite-austenite phase | Present Example |
| P | Satisfied | 0.131 | Ferrite-austenite phase | Present Example |
| Q | Satisfied | 0.133 | Ferrite-austenite phase | Present Example |
| R | Satisfied | 0.137 | Ferrite-austenite phase | Present Example |
| S | Satisfied | 0.118 | Ferrite-austenite phase | Present Example |
| T | Satisfied | 0.144 | Ferrite-austenite phase | Present Example |
| U | Satisfied | 0.146 | Ferrite-austenite phase | Present Example |
| V | Satisfied | 0.137 | Ferrite-austenite phase | Present Example |
| W | Satisfied | 0.130 | Ferrite-austenite phase | Present Example |
| X | Satisfied | 0.122 | Ferrite-austenite phase | Present Example |
| Y | Satisfied | 0.141 | Ferrite-austenite phase | Present Example |
| Z | Satisfied | 0.137 | Ferrite-austenite phase | Present Example |
| AA | Satisfied | 0.122 | Ferrite-austenite phase | Present Example |
| AB | Satisfied | 0.128 | Ferrite-austenite phase | Present Example |
| AC | Satisfied | 0.123 | Ferrite-austenite phase | Present Example |
| AD | Satisfied | 0.136 | Ferrite-austenite phase | Present Example |
| AE | Unsatisfied | 0.167 | Ferrite-austenite phase | Comparative Example |
| AF | Unsatisfied | 0.165 | Ferrite-austenite phase | Comparative Example |
| AG | Unsatisfied | 0.157 | Ferrite-austenite phase | Comparative Example |
| AH | Satisfied | 0.130 | Ferrite + austenite phase | Comparative Example |
| AI | Satisfied | 0.144 | Ferrite phase | Comparative Example |
| AJ | Satisfied | 0.125 | Ferrite + austenite phase | Comparative Example |
| AK | Satisfied | 0.117 | Ferrite + austenite phase | Comparative Example |

Formula (1): $0.150 > N - (1.58Ti + 2.70Al + 1.58V + 1.44Nb)$

After hot rolling, the round billet was recharged into the heating furnace, and was held at a high temperature of 1,200° C. or more. The material was then hot formed into a raw seamless pipe having an outer diameter ϕ of 70 mm, and an inner diameter of 58 mm (wall thickness=6 mm), using a Mannesmann piercing roll mill. After hot forming, the raw pipes of different compositions were each subjected to a solid-solution heat treatment at a temperature that brings the fractions of ferrite phase and austenite phase to an appropriate duplex state. This was followed by strengthening. This was achieved by drawing rolling, a type of axial stretching technique, and bending and rebending, as shown in Table 3. After drawing rolling or bending and rebending, a part of pipe was cut out, and the microstructure was observed to confirm that the microstructure was a duplex microstructure with appropriate fractions of ferrite phase and austenite phase.

The sample was then subjected to an EBSD crystal orientation analysis that observed a cross section across the wall thickness taken parallel to the pipe axis, and austenite grains separated by a crystal orientation angle of 15° were measured for aspect ratio. The measurement was made over a 1.2 mm×1.2 mm area, and the aspect ratio was measured for austenite grains that had a grain size of 10 μm or more in terms of a diameter of an imaginary true circle.

The drawing rolling was performed under the conditions that reduce the wall thickness by 3 to 20%, and the outer circumference by 3 to 20%. For bending and rebending, a rolling mill was prepared that had three cylindrical rolls disposed at a pitch of 120° around the outer circumference of pipe (FIG. 1, (c)). The pipe was processed by being rotated with the rolls rolling around the outer circumference of pipe with a roll distance smaller than the outer diameter of the pipe by 10 to 15%. In selected conditions, the pipes were subjected to warm working at 150 to 550° C. In selected conditions, the pipes after cold working and warm working were subjected to a low-temperature heat treatment at 150 to 550° C.

The steel pipes after the cold working, warm working, and low-temperature heat treatment were measured for axial tensile yield strength and axial compressive yield strength along the length of pipe, and for circumferential compressive yield strength. The steel pipes were also measured for axial tensile yield strength, on which grading of steel pipes intended for oil wells and gas wells is based. As an evaluation of strength anisotropy, the steel pipes were measured for a ratio of axial compressive yield strength to axial tensile yield strength, and a ratio of circumferential compressive yield strength to axial tensile yield strength.

The steel pipes were also subjected to a stress corrosion test in a chloride-sulfide environment. The corrosive environment was created by preparing an aqueous solution that simulates a mining environment encountered by oil country tubular goods (a 20% NaCl+0.5% $CH_3COOH$+$CH_3COONa$ aqueous solution with added $H_2S$ gas under a pressure of 0.01 to 0.10 MPa; an adjusted pH of 3.0; test temperature=25° C.). In order to be able to longitudinally apply stress along the pipe axis, a 4-point bending test piece with a wall thickness of 5 mm was cut out, and a stress 90% of the axial tensile yield strength of pipe was applied before dipping the test piece in the corrosive solution. For evaluation of corrosion, samples were evaluated as acceptable when no crack was observed (cracking is absent) on the stressed surface immediately after the sample dipped in the corrosive aqueous solution for 720 hours under applied stress was taken out of the solution. Samples were evaluated as unacceptable when a crack was observed (cracking was present) under the same conditions.

The manufacturing conditions are presented in Table 3, along with the evaluation results.

The processing method, runs (passes), and processing temperature in the table refer to those of processes (specifically, drawing rolling and bending and rebending) carried out to further strengthen the hot rolled steel pipe after the heat treatment.

TABLE 3

| No. | Steel type | Processing method | Runs Pass | Processing. Temp. ° C. | Heat-treatment Temp. ° C. | Axial tensile yield strength MPa | Aspect ratio |
|---|---|---|---|---|---|---|---|
| 1 | A | Drawing rolling | 1 | OT | — | 735 | 6.6 |
| 2 | A | Drawing rolling | 1 | OT | 450 | 733 | 6.5 |
| 4 | A | Bending and rebending | 1 | OT | — | 745 | 4.1 |
| 5 | A | Bending and rebending | 1 | OT | 450 | 744 | 4.2 |
| 6 | B | Drawing rolling | 1 | OT | — | 759 | 9.1 |
| 10 | B | Bending and rebending | 1 | OT | — | 762 | 4.1 |
| 11 | C | Drawing rolling | 1 | OT | 350 | 766 | 9.1 |
| 12 | C | Bending and rebending | 1 | OT | — | 768 | 3.7 |
| 13 | D | Drawing rolling | 1 | 400 | — | 771 | 6.5 |
| 14 | D | Bending and rebending | 1 | OT | — | 775 | 3.5 |
| 15 | E | Drawing rolling | 1 | OT | — | 773 | 8.6 |
| 16 | E | Drawing rolling | 1 | OT | 350 | 773 | 8.5 |
| 17 | E | Bending and rebending | 1 | OT | — | 781 | 2.2 |
| 18 | F | Bending and rebending | 1 | OT | — | 785 | 1.8 |
| 19 | F | Bending and rebending | 1 | OT | 350 | 785 | 2.0 |
| 20 | G | Bending and rebending | 1 | 300 | — | 825 | 3.4 |
| 21 | G | Bending and rebending | 1 | OT | 350 | 828 | 3.3 |
| 22 | H | Bending and rebending | 1 | OT | — | 863 | 3.1 |
| 23 | I | Bending and rebending | 1 | OT | — | 864 | 3.0 |
| 24 | J | Bending and rebending | 1 | OT | — | 875 | 2.8 |
| 25 | K | Bending and rebending | 2 | OT | — | 885 | 2.5 |
| 26 | L | Bending and rebending | 1 | OT | — | 795 | 3.3 |
| 27 | M | Bending and rebending | 2 | OT | — | 868 | 3.4 |
| 28 | N | Bending and rebending | 1 | OT | — | 875 | 2.8 |
| 29 | O | Bending and rebending | 2 | OT | — | 896 | 2.4 |
| 30 | O | Bending and rebending | 2 | OT | 300 | 897 | 2.4 |
| 31 | P | Bending and rebending | 1 | OT | — | 798 | 3.8 |
| 32 | Q | Bending and rebending | 1 | OT | — | 803 | 3.7 |
| 33 | Q | Bending and rebending | 2 | 450 | 300 | 863 | 3.5 |
| 34 | R | Bending and rebending | 2 | OT | — | 889 | 4.1 |
| 35 | S | Bending and rebending | 2 | OT | — | 868 | 4.3 |
| 36 | T | Bending and rebending | 2 | OT | — | 868 | 4.9 |
| 37 | U | Bending and rebending | 1 | OT | — | 876 | 3.2 |
| 38 | U | Bending and rebending | 1 | OT | 450 | 925 | 3.2 |
| 39 | V | Bending and rebending | 2 | OT | — | 895 | 2.4 |
| 40 | W | Bending and rebending | 1 | OT | — | 912 | 2.6 |
| 41 | X | Bending and rebending | 2 | OT | — | 910 | 2.8 |
| 42 | Y | Bending and rebending | 1 | OT | — | 894 | 3.2 |
| 43 | Z | Bending and rebending | 1 | OT | — | 864 | 3.6 |
| 44 | AA | Bending and rebending | 1 | OT | — | 864 | 3.5 |
| 45 | AA | Drawing | 1 | 630 | — | 685 | 8.7 |
| 46 | AB | Bending and rebending | 1 | OT | — | 876 | 3.8 |
| 47 | AC | Bending and rebending | 1 | OT | 450 | 954 | 3.8 |
| 48 | AC | Drawing | 1 | OT | 630 | 693 | 9.1 |
| 49 | AD | Bending and rebending | 1 | OT | — | 862 | 1.4 |
| 50 | AE | Bending and rebending | 1 | OT | 350 | 772 | 4.3 |
| 51 | AE | Drawing rolling | 1 | OT | 450 | 771 | 8.8 |
| 52 | AF | Bending and rebending | 1 | OT | 350 | 766 | 4.6 |
| 53 | AF | Drawing rolling | 1 | 450 | 350 | 781 | 9.1 |
| 54 | AG | Bending and rebending | 1 | 350 | 300 | 745 | 3.8 |
| 55 | AG | Drawing rolling | 1 | OT | 450 | 744 | 7.9 |
| 56 | AH | Bending and rebending | 1 | OT | — | 766 | 3.2 |
| 57 | AI | Bending and rebending | 1 | OT | — | 566 | *Unmeas-urable |
| 58 | AJ | Bending and rebending | 1 | OT | — | 775 | 4.5 |
| 59 | AK | Bending and rebending | 1 | OT | — | 853 | 3.5 |

| No. | Axial compressive yield strength/axial tensile yield strength | Circumferential compressive strength MPa | Circumferential compressive yield strength/ axial tensile yield strength | Cracking Present or absent | Remarks |
|---|---|---|---|---|---|
| 1 | 0.81 | 745 | 1.01 | Absent | Comparative Example |
| 2 | 0.86 | 742 | 1.01 | Absent | Comparative Example |
| 4 | 1.03 | 754 | 1.01 | Absent | Comparative Example |
| 5 | 1.02 | 755 | 1.01 | Absent | Comparative Example |
| 6 | 0.81 | 768 | 1.01 | Absent | Comparative Example |
| 10 | 1.04 | 775 | 1.02 | Absent | Present Example |
| 11 | 0.86 | 772 | 1.01 | Absent | Present Example |
| 12 | 1.03 | 778 | 1.01 | Absent | Present Example |
| 13 | 0.86 | 779 | 1.01 | Absent | Present Example |
| 14 | 1.04 | 786 | 1.01 | Absent | Present Example |
| 15 | 0.79 | 785 | 1.02 | Absent | Comparative Example |
| 16 | 0.86 | 786 | 1.02 | Absent | Present Example |

TABLE 3-continued

| | | | | | |
|---|---|---|---|---|---|
| 17 | 1.03 | 788 | 1.01 | Absent | Present Example |
| 18 | 1.03 | 795 | 1.01 | Absent | Present Example |
| 19 | 1.01 | 799 | 1.02 | Absent | Present Example |
| 20 | 1.01 | 836 | 1.01 | Absent | Present Example |
| 21 | 1.02 | 842 | 1.02 | Absent | Present Example |
| 22 | 1.03 | 882 | 1.02 | Absent | Present Example |
| 23 | 1.03 | 888 | 1.03 | Absent | Present Example |
| 24 | 1.04 | 895 | 1.02 | Absent | Present Example |
| 25 | 1.04 | 912 | 1.03 | Absent | Present Example |
| 26 | 1.03 | 825 | 1.04 | Absent | Present Example |
| 27 | 1.03 | 879 | 1.01 | Absent | Present Example |
| 28 | 1.04 | 903 | 1.03 | Absent | Present Example |
| 29 | 1.04 | 912 | 1.02 | Absent | Present Example |
| 30 | 1.03 | 915 | 1.02 | Absent | Present Example |
| 31 | 1.03 | 814 | 1.02 | Absent | Present Example |
| 32 | 1.03 | 823 | 1.02 | Absent | Present Example |
| 33 | 1.01 | 878 | 1.02 | Absent | Present Example |
| 34 | 1.03 | 898 | 1.01 | Absent | Present Example |
| 35 | 1.03 | 879 | 1.01 | Absent | Present Example |
| 36 | 1.08 | 893 | 1.03 | Absent | Present Example |
| 37 | 1.08 | 896 | 1.02 | Absent | Present Example |
| 38 | 1.04 | 933 | 1.01 | Absent | Present Example |
| 39 | 1.07 | 921 | 1.03 | Absent | Present Example |
| 40 | 1.08 | 933 | 1.02 | Absent | Present Example |
| 41 | 1.07 | 925 | 1.02 | Absent | Present Example |
| 42 | 1.05 | 912 | 1.02 | Absent | Present Example |
| 43 | 1.04 | 885 | 1.02 | Absent | Present Example |
| 44 | 1.04 | 879 | 1.02 | Absent | Present Example |
| 45 | 1.01 | 703 | 1.03 | Absent | Comparative Example |
| 46 | 1.04 | 889 | 1.01 | Absent | Present Example |
| 47 | 1.04 | 985 | 1.03 | Absent | Present Example |
| 48 | 1.01 | 704 | 1.02 | Absent | Comparative Example |
| 49 | 1.09 | 896 | 1.04 | Absent | Present Example |
| 50 | 1.03 | 788 | 1.02 | Present | Comparative Example |
| 51 | 0.86 | 789 | 1.02 | Present | Comparative Example |
| 52 | 1.02 | 781 | 1.02 | Present | Comparative Example |
| 53 | 0.86 | 798 | 1.02 | Present | Comparative Example |
| 54 | 1.02 | 765 | 1.03 | Present | Comparative Example |
| 55 | 0.86 | 754 | 1.01 | Present | Comparative Example |
| 56 | 0.98 | 728 | 0.95 | Present | Comparative Example |
| 57 | 0.98 | 549 | 0.97 | Present | Comparative Example |
| 58 | 0.96 | 736 | 0.95 | Present | Comparative Example |
| 59 | 0.94 | 819 | 0.96 | Present | Comparative Example |

*No. 57 was solely ferrite phase, and the aspect ratio of austenite phase was unmeasurable.
OT: Ordinary temperature
PE: Present Example;
CE: Comparative Example As can be seen from the results shown in Table 3, the corrosion resistance and the axial tensile strength were desirable in all of the present examples, and the difference between axial tensile yield strength and compressive yield strength was small in the present examples. In contrast, in Comparative Examples, the results did not satisfy the required level in corrosion resistance, axial tensile yield strength, or compressive yield strength-to-axial tensile yield strength ratio.

The invention claimed is:

1. A duplex stainless steel seamless pipe of a composition comprising, in mass %, C: 0.005 to 0.08%, Si: 0.01 to 1.0%, Mn: 0.01 to 10.0%, Cr: 20 to 35%, Ni: 1 to 15%, Mo: 0.5 to 6.0%, N: 0.150 to less than 0.400%, and one, two or more selected from Ti: 0.0001 to 0.3%, Al: 0.0001 to 0.3%, V: 0.005 to 1.5%, Nb: 0.005 to less than 1.5%, and the balance being Fe and incidental impurities, the duplex stainless steel seamless pipe containing N, and one, two or more selected from Ti, Al, V, and Nb so as to satisfy the following formula (1), the duplex stainless steel seamless pipe having an axial tensile yield strength of 757 MPa or more, and a ratio of 0.85 to 1.15 as a fraction of axial compressive yield strength to axial tensile yield strength, $$0.150>N-(1.58Ti+2.70Al+1.58V+1.44Nb) \quad (1),$$

wherein N, Ti, Al, V, and Nb represent the content of each element in mass % and the content is 0 (zero) percent for elements that are not contained.

2. The duplex stainless steel seamless pipe according to claim 1, which has a ratio of 0.85 or more as a fraction of circumferential compressive yield strength to axial tensile yield strength.

3. The duplex stainless steel seamless pipe according to claim 1, which further comprises one or more of the following groups A and B:

Group A: in mass %, one or two selected from W: 0.1 to 6.0%, and Cu: 0.1 to 4.0%; and Group B: in mass %, one, two or more selected from B: 0.0001 to 0.010%, Zr: 0.0001 to 0.010%, Ca: 0.0001 to 0.010%, Ta: 0.0001 to 0.3%, and REM: 0.0001 to 0.010%.

4. The duplex stainless steel seamless pipe according to claim 2, which further comprises one or more of the following groups A and B:

Group A: in mass %, one or two selected from W: 0.1 to 6.0%, and Cu: 0.1 to 4.0%; and Group B: in mass %, one, two or more selected from B: 0.0001 to 0.010%, Zr: 0.0001 to 0.010%, Ca: 0.0001 to 0.010%, Ta: 0.0001 to 0.3%, and REM: 0.0001 to 0.010%.

5. A method for manufacturing the duplex stainless steel seamless pipe of claim 1, the method comprising stretching along a pipe axis direction followed by a heat treatment at a heating temperature of 150 to 600° C., excluding 460 to 480° C.

6. A method for manufacturing the duplex stainless steel seamless pipe of claim 3, the method comprising stretching along a pipe axis direction followed by a heat treatment at a heating temperature of 150 to 600° C., excluding 460 to 480° C.

7. A method for manufacturing the duplex stainless steel seamless pipe of claim 1, the method comprising stretching along a pipe axis direction at a temperature of 150 to 600° C., excluding 460 to 480° C.

8. A method for manufacturing the duplex stainless steel seamless pipe of claim 3, the method comprising stretching along a pipe axis direction at a temperature of 150 to 600° C., excluding 460 to 480° C.

9. The method according to claim 7, wherein the stretching is followed by a heat treatment at a heating temperature of 150 to 600° C., excluding 460 to 480° C.

10. The method according to claim 8, wherein the stretching is followed by a heat treatment at a heating temperature of 150 to 600° C., excluding 460 to 480° C.

11. A method for manufacturing the duplex stainless steel seamless pipe of claim 1, the method comprising circumferential bending and rebending.

12. A method for manufacturing the duplex stainless steel seamless pipe of claim 3, the method comprising circumferential bending and rebending.

13. The method according to claim 11, wherein the circumferential bending and rebending is performed at a temperature of 600° C. or less, excluding 460 to 480° C.

14. The method according to claim 12, wherein the circumferential bending and rebending is performed at a temperature of 600° C. or less, excluding 460 to 480° C.

15. The method according to claim 11, wherein the bending and rebending is followed by a heat treatment at a heating temperature of 150 to 600° C., excluding 460 to 480° C.

16. The method according to claim 12, wherein the bending and rebending is followed by a heat treatment at a heating temperature of 150 to 600° C., excluding 460 to 480° C.

17. The method according to claim 13, wherein the bending and rebending is followed by a heat treatment at a heating temperature of 150 to 600° C., excluding 460 to 480° C.

18. The method according to claim 14, wherein the bending and rebending is followed by a heat treatment at a heating temperature of 150 to 600° C., excluding 460 to 480° C.

* * * * *